US006686116B1

(12) United States Patent
Dickerson et al.

(10) Patent No.: US 6,686,116 B1
(45) Date of Patent: Feb. 3, 2004

(54) BLUE SPECTRALLY SENSITIZED FILM FOR RADIOGRAPHY, IMAGING ASSEMBLY AND METHOD

(75) Inventors: Robert E. Dickerson, Hamlin, NY (US); Anthony Adin, Rochester, NY (US); Stephen A. Hershey, Victor, NY (US); Richard F. Davis, Rochester, NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 10/397,435

(22) Filed: Mar. 26, 2003

(51) Int. Cl.[7] ..... G03C 5/17; G03C 1/015; G03C 1/047; G03C 1/046; G03C 1/29

(52) U.S. Cl. ..... 430/139; 430/434; 430/502; 430/567; 430/569; 430/572; 430/574; 430/642; 430/966; 430/967

(58) Field of Search ..... 430/139, 434, 430/502, 567, 569, 642, 966, 967, 572, 574

(56) References Cited

U.S. PATENT DOCUMENTS

| | | | | | |
|---|---|---|---|---|---|
| 3,591,379 | A | | 7/1971 | Plakunov | |
| 3,708,302 | A | | 1/1973 | Plakunov et al. | |
| 3,848,133 | A | | 11/1974 | Blanc et al. | |
| 4,130,428 | A | | 12/1978 | Van Doorselaer | |
| 4,130,429 | A | | 12/1978 | Van Doorselaer | |
| 4,425,425 | A | * | 1/1984 | Abbott et al. | 430/502 |
| 4,425,426 | A | * | 1/1984 | Abbott et al. | 430/502 |
| 4,518,689 | A | | 5/1985 | Noguchi et al. | |
| 4,665,012 | A | | 5/1987 | Sugimoto et al. | |
| 4,713,320 | A | * | 12/1987 | Maskasky | 430/567 |
| 4,801,526 | A | | 1/1989 | Yoshida et al. | |
| 5,087,555 | A | | 2/1992 | Saitou | |
| 5,219,720 | A | * | 6/1993 | Black et al. | 430/567 |
| 5,318,888 | A | | 6/1994 | Weberg et al. | |
| 5,595,864 | A | | 1/1997 | Van den Zegel et al. | |
| 5,629,142 | A | * | 5/1997 | Maskasky | 430/502 |
| 5,650,266 | A | | 7/1997 | Taguchi et al. | |
| 6,087,085 | A | | 7/2000 | Elst | |
| 6,348,293 | B1 | * | 2/2002 | Verbeeck et al. | 430/502 |
| 6,350,554 | B1 | * | 2/2002 | Dickerson et al. | 430/502 |

FOREIGN PATENT DOCUMENTS

EP 0 712 034 B1 4/2002

OTHER PUBLICATIONS

USSN 10/397691 (D–85620) Davis et al., titled *Blue–Sensitive Film For Radiography And Imaging Assembly And Method* filed on even date herewith.

USSN 10/397567 (D–85622) Dickerson et al., titled *Radiographic Imaging Assembly With Blue–Sensitive Film* filed on even date herewith.

* cited by examiner

*Primary Examiner*—Richard L. Schilling
(74) *Attorney, Agent, or Firm*—J. Lanny Tucker

(57) ABSTRACT

A blue-sensitive radiographic silver halide film comprises a silver halide emulsion layer comprising predominantly tabular silver halide grains that have an aspect ratio of at least 15, a grain thickness of at least 0.1 $\mu$m, and comprise at least 90 mol % bromide and up to 4 mol % iodide, based on total silver halide. Substantially all of the iodide is present in an internal localized portion of the tabular silver halide grains that excludes the surface of the grains. The tabular silver halide grains are dispersed in a hydrophilic polymeric vehicle mixture comprising at least 0.5% of oxidized gelatin, based on the total dry weight of the polymeric vehicle mixture in the emulsion layer. The tabular silver halide grains are spectrally sensitized using a combination of spectral sensitizing dyes to provide increased speed and reduced dye stain. The dyes have maximum J-aggregate absorptions on the tabular silver halide grains of from about 380 to about 500 nm, wherein the maximum J-aggregate absorption of one spectral sensitizing dye is from about 20 to about 50 nm lower in wavelength than the maximum J-aggregate absorption of the second spectral sensitizing dye.

24 Claims, No Drawings

BLUE SPECTRALLY SENSITIZED FILM FOR RADIOGRAPHY, IMAGING ASSEMBLY AND METHOD

FIELD OF THE INVENTION

This invention is directed to radiography. In particular, it is directed to blue light-sensitive radiographic silver halide films that have high sensitivity and low residual spectral sensitizing dye stain. This invention also provides an imaging assembly and a method of radiographic imaging using these improved radiographic films.

BACKGROUND OF THE INVENTION

The use of radiation-sensitive silver halide emulsions for medical diagnostic imaging can be traced to Roentgen's discovery of X-radiation by the inadvertent exposure of a silver halide film. Eastman Kodak Company then introduced its first product specifically that was intended to be exposed by X-radiation in 1913. The discovery of X-rays in 1895 provided the beginning of a new way of providing medical evaluation and diagnosis. Prior to that time, medical examination comprised predominantly manual probing and consideration of symptoms. Such examinations would obviously be incomplete and inconclusive in most instances, and incorrect in some instances. In some cultures, there was a prohibition of touching the female anatomy, further limiting the effectiveness of medical examination. Thus, the discovery that X-radiation could pass through the body with relatively little harm and provide useful images provided a powerful tool in medical diagnosis and treatment.

In conventional medical diagnostic imaging the object is to obtain an image of a patient's internal anatomy with as little X-radiation exposure as possible. The fastest imaging speeds are realized by mounting a dual-coated radiographic element between a pair of fluorescent intensifying screens for imagewise exposure. About 5% or less of the exposing X-radiation passing through the patient is adsorbed directly by the latent image forming silver halide emulsion layers within the dual-coated radiographic element. Most of the X-radiation that participates in image formation is absorbed by phosphor particles within the fluorescent screens. This stimulates light emission that is more readily absorbed by the silver halide emulsion layers of the radiographic element.

Examples of radiographic element constructions for medical diagnostic purposes are provided by U.S. Pat. No. 4,425,425 (Abbott et al.) and U.S. Pat. No. 4,425,426 (Abbott et al.), U.S. Pat. No. 4,414,310 (Dickerson), U.S. Pat. No. 4,803,150 (Dickerson et al.), U.S. Pat. No. 4,900,652 (Dickerson et al.), U.S. Pat. No. 5,252,442 (Tsaur et al.), and *Research Disclosure*, Vol. 184, August 1979, Item 18431.

Problem to be Solved

Some commercial radiographic films that are available from Eastman Kodak Company and Agfa-Gevaert are sensitive to blue light and designed to be used in combination with blue-emitting fluorescent intensifying screens such as those containing calcium tungstate as the phosphor. Those films generally contain high silver coverage in the form of grains having cubic or other 3-dimensional morphology. The emulsion layers in those films are relatively "soft" meaning that relatively low levels of film hardener are used, in order to maximize covering power and to reduce drying time after processing with wet chemistries. However, the higher silver coverage contributed to longer processing times.

In addition, the silver halide emulsions in such films are generally "internally fogged" meaning that the emulsion grains have internal latent image sensitivity. Such emulsions, when coated in combination with high silver iodide emulsions sufficient to release iodide upon development to render the internally fogged emulsion developable, results in higher covering power than would be possible with the silver iodide emulsions. This property can provide the advantage of lower silver coverage and improved processing compared to higher silver containing films, but it is also disadvantageous in that if the developer is contaminated with photographic fixers from the fixing tank, the internally fogged emulsion is developer prematurely and provided high fogging ($D_{min}$).

Silver halide grains have a natural sensitivity to "blue" light, but in order to enhance their sensitivity for use in radiographic films, spectral sensitizing dyes are used to match the radiographic film to the emission of the blue-light emitting intensifying screens. Various blue light absorbing spectral sensitizing dyes are known for this purpose as described, for example, in U.S. Pat. No. 4,518,689 (Noguchi et al.).

However, there is a risk that after wet processing of the radiographic films, blue light absorbing sensitizing dyes may not be completely removed in the processing solutions, resulting in residual dye stain that can detract from the desired radiographic image. If the stain is too high, of course, the image may be useless for the intended diagnostic use. In addition, the incorrect selection of spectral sensitizing dyes may diminish photographic speed.

There is a desire in the industry to have "blue-sensitive" or "blue-light sensitive" radiographic films that have reduced silver coverage and reduced stain from residual spectral sensitizing dye without a significant loss of desired sensitometric properties.

SUMMARY OF THE INVENTION

The present invention provides a blue-sensitive radiographic silver halide film comprising a support having first and second major surfaces, the radiographic silver halide film having disposed on the first major support surface, one or more hydrophilic colloid layers including a first silver halide emulsion layer, and on the second major support surface, one or more hydrophilic colloid layers including a second silver halide emulsion layer, the first silver halide emulsion layer comprising predominantly tabular silver halide grains that have an aspect ratio of at least 15, a grain thickness of at least 0.1 $\mu$m, and comprise at least 90 mol % bromide and up to 4 mol % iodide, based on total silver halide, substantially all of the iodide being present in an internal localized portion of the tabular silver halide grains that excludes the surface of the grains, wherein the tabular silver halide grains in the first silver halide emulsion layer are dispersed in a hydrophilic polymeric vehicle mixture comprising at least 0.5% of oxidized gelatin, based on the total dry weight of the polymeric vehicle mixture, and wherein the tabular silver halide grains in the first silver halide emulsion layer are spectrally sensitized with a combination of first and second spectral sensitizing dyes that has a maximum J-aggregate absorption on the tabular silver halide grains of from about 380 to about 500 nm, wherein the maximum J-aggregate absorption of the first spectral sensitizing dye is from about 20 to about 50 nm lower in wavelength than the maximum J-aggregate absorption of the second spectral sensitizing dye, the molar ratio of the first spectral sensitizing dye to the second spectral sensitizing dye being from about 0.25:1 to about 1:1, and the first and second spectral sensitizing dyes being present to provide from about 50 to 100% of saturation coverage of the tabular silver halide grains.

In preferred embodiments, the blue-sensitive, radiographic silver halide film of this invention comprises a support having first and second major surfaces, the radiographic silver halide film having disposed on the first major support surface, one or more hydrophilic colloid layers including a first silver halide emulsion layer, and on the second major support surface, one or more hydrophilic colloid layers including a second silver halide emulsion layer, the first and second silver halide emulsion layers having essentially the same composition and comprising predominantly tabular silver halide grains that have an aspect ratio of from about 20 to about 30, a grain thickness of from about 0.10 to about 0.14 $\mu$m, and comprising at least 95 mol % bromide and from about 1 to about 3.5 mol % iodide, based on total silver halide in each of the emulsion layers, substantially all of the iodide being present in an internal localized portion of the tabular silver halide grains that from about 1.7 to about 85% of the volume of the grains wherein 100% volume represents the surface of the grains, wherein the tabular silver halide grains in the first and second silver halide emulsion layers are dispersed in a hydrophilic polymeric vehicle mixture comprising from about 0.8% to about 1.2% of deionized oxidized gelatin, based on the total dry weight of the polymeric vehicle mixture, and wherein the tabular silver halide grains in the first and second silver halide emulsion layers are spectrally sensitized with a combination of first and second spectral sensitizing dyes that has a maximum J-aggregate absorption on the tabular silver halide grains of from about 410 to about 490 nm, wherein the maximum J-aggregate absorption of the first spectral sensitizing dye is from about 30 to about 45 nm lower in wavelength than the maximum J-aggregate absorption of said second spectral sensitizing dye, the molar ratio of the first spectral sensitizing dye to the second spectral sensitizing dye being from about 0.5:1 to about 1:1, and the first and second spectral sensitizing dyes being present to provide from about 70 to about 80% of saturation coverage of the tabular silver halide grains in both silver halide emulsion layers, the first spectral sensitizing dye being one of the following dyes I-1 through I-11 shown below, and the second spectral sensitizing dye being one of the following dyes II-1 through II-11 shown below.

In addition, this invention provides a photosensitive silver halide emulsion comprising predominantly tabular silver halide grains that have an aspect ratio of at least 15, a grain thickness of at least 0.1 $\mu$m, and comprise at least 90 mol % bromide and up to 4 mol % iodide, based on total silver halide, substantially all of the iodide being present in an internal localized portion of the tabular silver halide grains that excludes the surface of the grains, wherein the tabular silver halide grains are dispersed in a hydrophilic polymeric vehicle mixture comprising at least 0.3 g and up to 27 g of oxidized gelatin per mole of silver in the emulsion, and wherein the tabular silver halide grains are spectrally sensitized with a combination of first and second spectral sensitizing dyes that has a maximum J-aggregate absorption on the tabular silver halide grains of from about 380 to about 500 nm, wherein the maximum J-aggregate absorption of the first spectral sensitizing dye is from about 20 to about 50 nm lower in wavelength than the maximum J-aggregate absorption of the second spectral sensitizing dye, the molar ratio of the first spectral sensitizing dye to the second spectral sensitizing dye being from about 0.25:1 to about 1:1, and the first and second spectral sensitizing dyes being present to provide from about 50 to 100% of saturation coverage of the tabular silver halide grains.

This invention also provides a radiographic imaging assembly comprising:

A) the blue-sensitive, radiographic silver halide film of this invention as described herein, and B) a fluorescent intensifying screen that comprises an inorganic phosphor capable of absorbing X-rays and emitting electromagnetic radiation having a wavelength of from about 360 to about 540 nm, the inorganic phosphor being coated in admixture with a polymeric binder in a phosphor layer onto a flexible support and having a protective overcoat disposed over the phosphor layer.

Further, this invention provides a method of providing a black-and-white image comprising exposing the radiographic imaging assembly of this invention, and processing the blue-sensitive radiographic silver halide film, sequentially, with a black-and-white developing composition and a fixing composition, the processing being carried out within 90 seconds, dry-to-dry.

In addition, a method of providing a black-and-white image comprises exposing the blue-sensitive radiographic silver halide film of this invention, and processing the blue-sensitive radiographic silver halide film, sequentially, with a black-and-white developing composition and a fixing composition, the processing being carried out within 90 seconds, dry-to-dry.

The present invention provides an improved blue-sensitive, radiographic film with relatively lower silver coverage than known films and reduced stain from residual spectral sensitizing dyes without significant loss in sensitometric properties such as speed and maximum density. In fact, the photographic speed of the film is actually increased.

These advantages are achieved by a combination of properties in the radiographic film emulsions. Thus, the emulsions contain high aspect tabular grains that have a thickness of at least 0.1 $\mu$m and include up to 4 mol % iodide based on total silver. This iodide is in localized portions of the grains that do not include the grain surface or the most internal nucleated and early-growth portions of the grains. In addition, the coated tabular grains are dispersed in a hydrophilic polymeric binder mixture that includes at least 0.5 weight % of oxidized gelatin based on the total dry weight of the polymeric vehicle mixture. The emulsion formulation used to make the coated silver halide emulsion layer is similar in composition except that the level of oxidized gelatin is generally higher because additional polymer binders (such as non-oxidized gelatin) are usually added prior to coating. For example, the emulsion formulation can include at least 0.3 g of oxidized gelatin per mole of silver.

In addition, a combination of two classes of blue light absorbing spectral sensitizing dyes are used that expectedly provides increased photographic speed and reduced residual dye stain after the radiographic films of this invention are wet processed. This combination of "first" and "second" spectral sensitizing dyes has a maximum J-aggregate absorption on the tabular silver halide grains of from about 380 to about 500 nm, wherein the maximum J-aggregate absorption of the "first" spectral sensitizing dye is from about 20 to about 50 nm lower in wavelength than the maximum J-aggregate absorption of the "second" spectral sensitizing dye. In addition, the molar ratio of the "first" spectral sensitizing dye to the "second" spectral sensitizing dye is from about 0.25:1 to about 1:1, and the spectral sensitizing dyes are present to provide from about 50 to 100% of saturation coverage of the tabular silver halide grains.

DETAILED DESCRIPTION OF THE INVENTION

Definition of Terms

The term "contrast" as herein employed indicates the average contrast derived from a characteristic curve of a radiographic film using as a first reference point (1) a density ($D_1$) of 0.25 above minimum density and as a second reference point (2) a density ($D_2$) of 2.0 above minimum density, where contrast is $\Delta D$ (i.e. 1.75)$\div\Delta\log_{10}E$ ($\log_{10}E_2-\log_{10}E_1$), $E_1$ and $E_2$ being the exposure levels at the reference points (1) and (2).

"Gamma" is described as the instantaneous rate of change of a D logE sensitometric curve or the instantaneous contrast at any loge value.

"Photographic speed" for the radiographic silver halide films of this invention refers to the exposure necessary to obtain a density of at least 1.0 plus $D_{min}$ in the resulting black-and-white image.

Image tone (or dye stain) can be evaluated using conventional CIELAB (Commission Internationale de l'Eclairage) a* and b* values that can be evaluated using the techniques described by Billmeyer et al., *Principles of Color Technology*, 2nd Edition, Wiley & Sons, New York, 1981, Chapter 3. The a* value is a measure of reddish tone (positive a*) or greenish tone (negative a*). The b* value is a measure of bluish tone (negative b*) or yellowish tone (positive b*).

"Blue-sensitive" refers to sensitivity of the silver halide emulsion to a wavelength of from about 360 to about 540 nm, and preferably it refers to sensitivity to a wavelength of from about 380 to about 470 nm.

The term "fully forehardened" is employed to indicate the forehardening of hydrophilic colloid layers to a level that limits the weight gain of a radiographic film to less than 120% of its original (dry) weight in the course of wet processing. The weight gain is almost entirely attributable to the ingestion of water during such processing.

In referring to grains and silver halide emulsions containing two or more halides, the halides are named in order of ascending molar concentrations.

The term "aspect ratio" is used to define the ratio of tabular grain diameter to tabular grain thickness. Tabular grain diameter is calculated from a disc-centrifuge measurement and tabular grain thickness is determined from a reflectance measurement. Both measurements are performed using appropriate standards for calibration.

The term "covering power" is used to indicate 100 times the ratio of maximum density to developed silver measured in $mg/dm^2$.

The term "dual-coated" is used to define a radiographic film having silver halide emulsion layers disposed on both the front- and backsides of the support. The radiographic silver halide films used in the present invention are "dual-coated."

The term "fluorescent intensifying screen" refers to a screen that absorbs X-radiation and emits light. A "prompt" emitting fluorescent intensifying screen will emit light immediately upon exposure to radiation while a "storage" fluorescent screen can "store" the exposing X-radiation for emission at a later time when the screen is irradiated with other radiation (usually visible light).

The terms "front" and "back" refer to layers, films, or fluorescent intensifying screens nearer to and farther from, respectively, the source of X-radiation.

The term "rare earth" is used to indicate chemical elements having an atomic number of 39 or 57 through 71.

Research Disclosure is published by Kenneth Mason Publications, Ltd., Dudley House, 12 North St., Emsworth, Hampshire P010 7DQ England. It is also available from Emsworth Design Inc., 147 West 24th Street, New York, N.Y. 10011.

Radiographic Films

The blue-sensitive radiographic silver halide films of this invention include a flexible support having disposed on both sides thereof, one or more photographic silver halide emulsion layers as described below and optionally one or more non-radiation sensitive hydrophilic layer(s). The silver halide emulsions in the various layers on both sides of the support can be the same or different.

In preferred embodiments, the photographic silver halide film has the same silver halide emulsion(s) on both sides of the support. It is also preferred that the film has a protective overcoat (described below) over the silver halide emulsions on each side of the support.

The support can take the form of any conventional radiographic film support that is X-radiation and light transmissive. Useful supports for the films of this invention can be chosen from among those described in *Research Disclosure*, September 1996, Item 38957 XV. Supports and *Research Disclosure*, Vol. 184, August 1979, Item 18431, XII. Film Supports.

The support is preferably a transparent film support. In its simplest possible form the transparent film support consists of a transparent film chosen to allow direct adhesion of the hydrophilic silver halide emulsion layers or other hydrophilic layers. More commonly, the transparent film is itself hydrophobic and subbing layers are coated on the film to facilitate adhesion of the hydrophilic silver halide emulsion layers. Typically the film support is either colorless or blue tinted (tinting dye being present in one or both of the support film and the subbing layers). Referring to *Research Disclosure*, Item 38957, Section XV Supports, cited above, attention is directed particularly to paragraph (2) that describes subbing layers, and paragraph (7) that describes preferred polyester film supports.

Polyethylene terephthalate and polyethylene naphthalate are the preferred transparent film support materials.

In the more preferred embodiments, at least one non-light sensitive hydrophilic layer is included with one silver halide emulsion layer on each side of the film support. This layer may be called an interlayer or overcoat, or both.

Each side of the support comprises one or more silver halide emulsion layers. On at least one of those sides (and preferably on both sides), at least one silver halide emulsion that contain predominantly tabular silver halide grains (that is, more than 60 weight % of all grains and preferably at least 80 weight %) having an average aspect ratio greater than 15. Preferably, these grains have an aspect ratio of from about 20 to about 30. The optimal aspect ratio may be dependent upon the particular mol % of iodide present in the grains.

The average thickness of these tabular silver halide grains is at least 0.1 μm with an upper limit of 0.15 μm, and preferably the tabular silver halide grain thickness is from about 0.10 to about 0.14 μm.

These tabular silver halide grains particularly include predominantly (at least 90 mol %) bromide, preferably at least 95 mol % bromide, and more preferably at least 97 mol % bromide, based on total silver in the emulsion layer. In addition, these tabular grains have up to 4 mol % iodide, and preferably up to 3.5 mol % iodide, based on total silver in the emulsion layer. Preferably, the iodide content is at least 1 mol % and preferably at least 2 mol %, based on total silver in the emulsion layer. The tabular silver halide grains in each silver halide emulsion unit (or silver halide emulsion layers) can be the same or different, and there can be mixtures of tabular grains in an emulsion layer having different halide composition and aspect ratio as long as the conditions noted above are still met.

The silver halide emulsion layers on the opposing sides of the support are identified herein as "first" and "second" silver halide emulsion layers with the "first" layer being disposed on the side of the film that is exposed first. Preferably, these "first" and "second" silver halide emulsion layers have the same composition (for example, type of grains, grain halide composition, silver coverage, and hydrophilic polymeric vehicle mixture).

Thus, either or both of the first and second silver halide emulsion layers can have the same or different composition and comprise predominantly tabular silver halide grains that have an aspect ratio of at least 15, a grain thickness of at least 0.1 μm, and comprise at least 90 mol % bromide and up to 4 mol % iodide, based on total silver halide, substantially all of the iodide being present in an internal localized portion of the tabular silver halide grains that excludes the surface of the grains, wherein the tabular silver halide grains in the first and/or second silver halide emulsion layers are dispersed in a hydrophilic polymeric vehicle mixture comprising at least 0.5% of oxidized gelatin, based on the total dry weight of the polymeric vehicle mixture in the first and/or second emulsion layers, and the tabular silver halide grains are spectrally sensitized with the combination of first and second spectral sensitizing dyes that described below.

Tabular grain emulsions that have the desired composition and sizes are described in greater detail in the following patents, the disclosures of which are incorporated herein by reference:

U.S. Pat. No. 4,414,310 (Dickerson), U.S. Pat. No. 4,425,425 (Abbott et al.), U.S. Pat. No. 4,425,426 (Abbott et al.), U.S. Pat. No. 4,439,520 (Kofron et al.), U.S. Pat. No. 4,434,226 (Wilgus et al.), U.S. Pat. No. 4,435,501 (Maskasky), U.S. Pat. No. 4,713,320 (Maskasky), U.S. Pat. No. 4,803,150 (Dickerson et al.), U.S. Pat. No. 4,900,355 (Dickerson et al.), U.S. Pat. No. 4,994,355 (Dickerson et al.), U.S. Pat. No. 4,997,750 (Dickerson et al.), U.S. Pat. No. 5,021,327 (Bunch et al.), U.S. Pat. No. 5,147,771 (Tsaur et al.), U.S. Pat. No. 5,147,772 (Tsaur et al.), U.S. Pat. No. 5,147,773 (Tsaur et al.), U.S. Pat. No. 5,171,659 (Tsaur et al.), U.S. Pat. No. 5,252,442 (Dickerson et al.), U.S. Pat. No. 5,370,977 (Zietlow), U.S. Pat. No. 5,391,469 (Dickerson), U.S. Pat. No. 5,399,470 (Dickerson et al.), U.S. Pat. No. 5,411,853 (Maskasky), U.S. Pat. No. 5,418,125 (Maskasky), U.S. Pat. No. 5,494,789 (Daubendiek et al.), U.S. Pat. No. 5,503,970 (Olm et al.), U.S. Pat. No. 5,536,632 (Wen et al.), U.S. Pat. No. 5,518,872 (King et al.), U.S. Pat. No. 5,567,580 (Fenton et al.), U.S. Pat. No. 5,573,902 (Daubendiek et al.), U.S. Pat. No. 5,576,156 (Dickerson), U.S. Pat. No. 5,576,168 (Daubendiek et al.), U.S. Pat. No. 5,576,171 (Olm et al.), and U.S. Pat. No. 5,582,965 (Deaton et al.).

The iodide present in the tabular silver halide grains described above is substantially all located in an "internal localized portion" of the grains. This means that substantially none of the iodide is present on the surfaces of the grains. This feature can be defined by the volume % of a grain wherein 0 volume % refers to the center of the grain and 100 volume % refers to the grain surface. In the present invention, the iodide is present in an internal localized portion at from about 1.5% to about 90 volume %. Preferably, the "beginning" of the internal localized portion is from about 1.5% to about 10 volume % and the "ending" of the internal localized portion is from about 65% to about 90 volume %. Thus, the nucleated internal portion of the grains contains no iodide. More preferably, the iodide is uniformly distributed throughout the internal localized portion represented by from about 1.7 to about 85 volume %.

This localization of the iodide within the tabular silver halide grains can be achieved using known procedures whereby preparation of the tabular silver halide grains is begun (nucleation and initial growth) without the presence of iodide. Then iodide is introduced during a predetermined portion of the manufacturing method until the desired volume % includes iodide, and manufacture of the grains is continued without iodide. A representative preparation is provided in the following paragraphs. Other details for making tabular grains in a similar manner are provided in U.S. Pat. No. 4,665,012 (Sugimoto et al.), incorporated herein by reference.

In general, the tabular grains useful in the practice of this invention can be prepared using a silver bromide-grain nucleation (and early growth) in a "bromide ion concentration free-fall" process with slow silver ion addition into a bromide ion-rich deionized oxidized gelatin environment. The number of grains having tabular morphology is enhanced using a brief period of silver solvent enhanced digestion. After digestion, additional gelatin of any type (preferably oxidized gelatin and preferably deionized oxidized gelatin) is added. Further grain growth is carried out by controlling the silver ion concentration in a halide-rich environment, using either bromide or iodobromide growth/control salts as required. Following grain growth, after washing out salts remaining in the solution phase of the emulsion, the emulsion is further peptized using a non-oxidized gelatin (such as deionized non-oxidized gelatin).

The silver halide emulsions described herein can have some non-tabular silver halide grains as long as they represent less than 40 weight % of the total grains in a given silver halide emulsion layer. Such grains can have any desirable morphology including, but not limited to, octahedral, tetradecahedral, rounded, spherical or other non-tabular or singularly-twinned or multiply-non-parallel twinned morphologies, or be comprised of a mixture of two or more of such morphologies.

A variety of silver halide dopants can be used, individually and in combination, to improve contrast as well as other common properties, such as speed and reciprocity characteristics. A summary of conventional dopants to improve speed, reciprocity and other imaging characteristics is provided by *Research Disclosure*, Item 38957, cited above, Section I. Emulsion grains and their preparation, sub-section D. Grain modifying conditions and adjustments, paragraphs (3), (4), and (5).

A general summary of silver halide emulsions and their preparation is provided by *Research Disclosure*, Item 38957, cited above, Section I. Emulsion grains and their preparation. After precipitation and before chemical sensitization the emulsions can be washed by any convenient conventional technique using techniques disclosed by *Research Disclosure*, Item 38957, cited above, Section III. Emulsion washing.

The emulsions can be chemically sensitized by any convenient conventional technique as illustrated by *Research Disclosure*, Item 38957, Section IV. Chemical Sensitization: Sulfur, selenium or gold sensitization (or any combination thereof) are specifically contemplated. Sulfur sensitization is preferred, and can be carried out using for example, thiosulfates, thiosulfonates, thiocyanates, isothiocyanates, thioethers, thioureas, cysteine or rhodanine. A combination of gold and sulfur sensitization is most preferred.

It is essential that the tabular silver halide grains used in the blue-sensitive radiographic films of this invention be spectrally sensitized using a combination of two different classes of spectral sensitizing dyes. This combination of first and second spectral sensitizing dyes provides a combined J-aggregate absorption within the range of from about 380 to about 500 nm (preferably from about 410 to about 490 nm) when absorbed on the tabular silver halide grains. The two dyes typically have different maximum absorption and thus, one is generally "lower" than the other dye. This "lower" dye is termed herein the "first" spectral sensitizing dye and has a maximum J-aggregate absorption of from about 20 to about 50 nm lower than the maximum J-aggregate absorption of the second ("higher") spectral sensitizing dye.

Multiple spectral sensitizing dyes of each type can be used if desired. Thus, two or more first spectral sensitizing dyes can be used with one or more second spectral sensitizing dyes, and the converse is also true. Preferably, only one of each type of spectral sensitizing dye is used in the present invention.

The molar ratio of the first spectral sensitizing dye to the second spectral sensitizing dye is from about 0.25:1 to about 1:1, and preferably it is from about 0.3:1 to about 0.8:1. The most preferred molar ratio is from about 0.4:1 to about 0.7:1. In addition, the combination of spectral sensitizing dyes is present in the silver halide emulsion containing the tabular silver halide grains in an amount sufficient to provide from about 50 to about 100% (preferably from about 70 to about 80%) of saturation coverage of the tabular silver halide grains. For most of the useful blue-light sensitive spectral sensitizing dyes, this would amount to from about 400 to about 800 mg/mole, or from about 0.55 to about 1.1 mmol/mole, of total silver in the silver halide emulsion layer. The particular amount with vary with the surface area of the tabular grains used in the emulsion. Optimum amounts will vary with the particular dyes used and a skilled worker in the art would understand how to achieve optimal results with the combination of dyes in appropriate amounts. Obviously, the spectral sensitizing dyes may also be absorbed to any silver halide grains that are not tabular in morphology.

In general, the first spectral sensitizing dye is an anionic benzimidazole-benzoxazole carbocyanine having at least one sulfo or carboxy group in the molecule, and the second spectral sensitizing dye is an anionic benzothiazole-benzothiazole carbocyanine having at least one sulfo or carboxy group in the molecule. Preferably, each of the first and second spectral sensitizing dyes has at least two sulfo groups in the molecule.

More particularly, the first spectral sensitizing dye is a monomethine carbocyanine dye represented by the following Structure I:

(I)

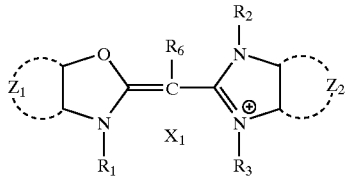

wherein $Z_1$ and $Z_2$ represent the carbon atoms necessary to form a substituted or unsubstituted benzene or naphthalene ring. Thus, the terms "benzothiazole", "benzoxazole", and "benzimidazole" used herein to define the spectral sensitizing dyes are intended to include compounds where $Z_1$ and $Z_2$ form naphthalene rings fused to the defined N-containing heterocyclic rings. Preferably, each of $Z_1$ and $Z_2$ independently represent the carbon atoms necessary to form a substituted or unsubstituted benzene ring.

In Structure I, $R_1$, $R_2$, and $R_3$ are independently alkyl groups having 1 to 10 carbon atoms, alkoxy groups having 1 to 10 carbon atoms, aryl groups having 6 to 10 carbon atoms in the aromatic ring, alkenyl groups having 2 to 8 carbon atoms, and other substituents that would be readily apparent to one skilled in the art. Such groups can be substituted with one or more hydroxy, alkyl, carbonamido, carboxy, sulfo, halo, and alkoxy groups. Preferably, at least one of the $R_1$, $R_2$, and $R_3$ groups comprises at least one sulfo or carboxy group.

More preferably, $R_1$, $R_2$, and $R_3$ are independently alkyl groups having 1 to 4 carbon atoms, phenyl groups, alkoxy groups having 1 to 4 carbon atoms, or alkenyl groups having 2 to 4 carbon atoms. All of these groups can be substituted as described above, and in particular, they can be substituted with a sulfo group.

$R_6$ is hydrogen, a substituted or unsubstituted alkyl group having 1 to 4 carbon atoms, or a phenyl group, each of which groups can be substituted as described above for the other radicals. Preferably, $R_6$ is hydrogen, or a methyl or ethyl group.

In Structure I, $X_1$ is a suitable anion or cation, as needed, to balance the charge of the dye molecule. Useful anions include, but are not limited to, halides, thiocyanate, sulfate, perchlorate, p-toluene sulfonate, ethyl sulfate, and other anions readily apparent to one skilled in the art. Suitable cations include, but are not limited to, alkali metal ions.

Particularly useful second spectral sensitizing dyes are monomethine cyanine dyes represented by the following Structure (II):

(II)

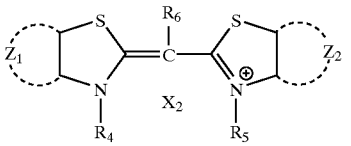

wherein $Z_1$ and $Z_2$ represent the carbon atoms necessary to form a substituted or unsubstituted benzene or naphthalene ring (as defined above for Structure I) and $R_4$ and $R_5$ are independently substituted or unsubstituted alkyl, alkoxy, aryl, or alkenyl groups as defined above for $R_1$ through $R_3$. $R_6$ is as defined above for Structure I. $X_2$ is a suitable anion or cation as defined above for $X_1$.

Preferably, $R_4$ and $R_5$ are independently alkyl groups having 1 to 4 carbon atoms, phenyl groups, alkoxy groups having 1 to 4 carbon atoms, or alkenyl groups having 2 to 4 carbon atoms.

Representative first spectral sensitizing dyes include the following Dyes I-1 through I-7, and representative second spectral sensitizing dyes include the following Dyes II-1 through II-10. A combination of Dyes I-1 and II-1 is most preferred in the practice of this invention.

(I-1)

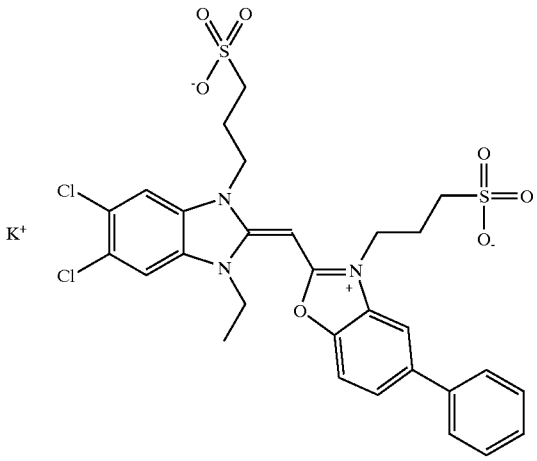

(I-2)

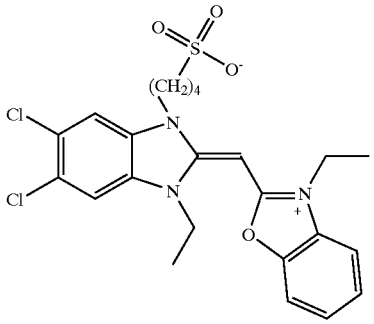

(I-3)

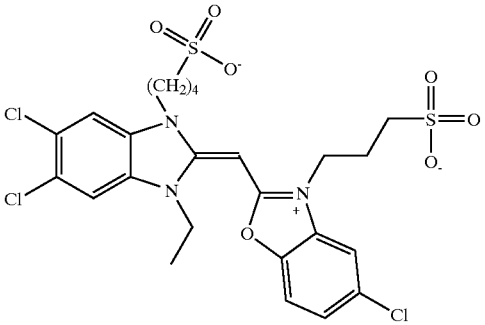

-continued (I-4)

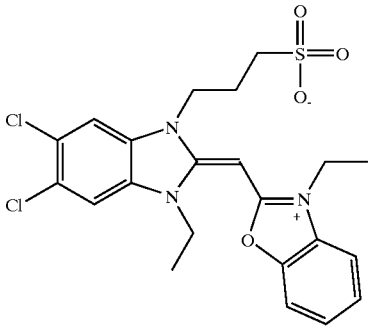

(I-5)

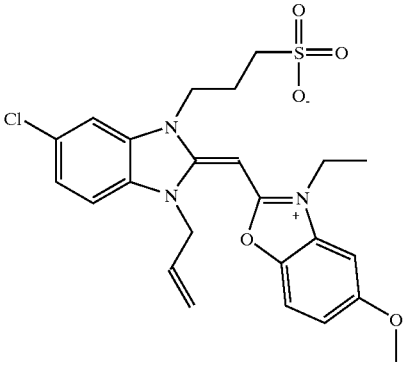

(I-6)

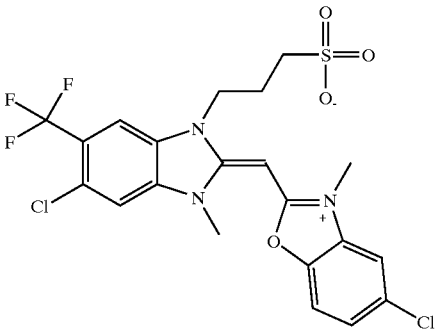

(I-7)

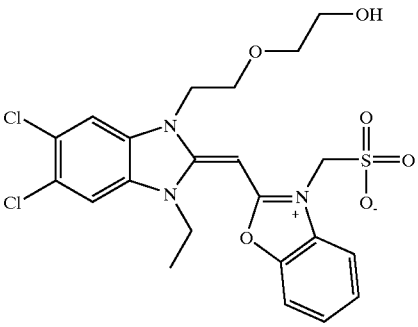

-continued
(II-1)
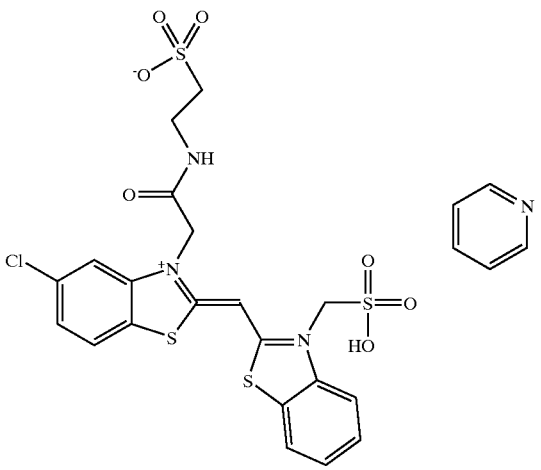
(II-2)
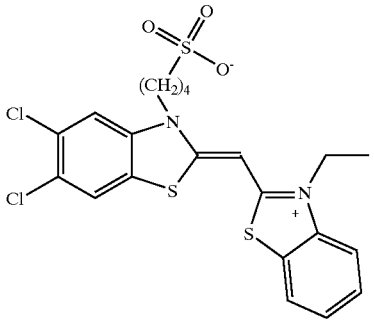
(II-3)
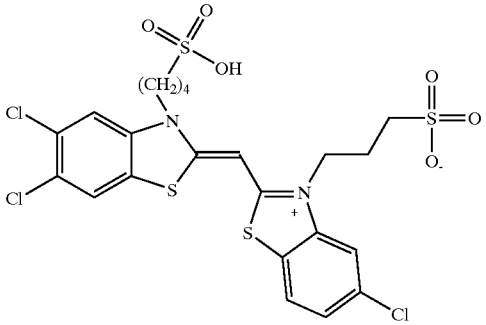
(II-4)
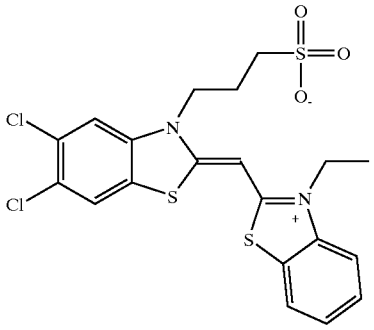
-continued
(II-5)
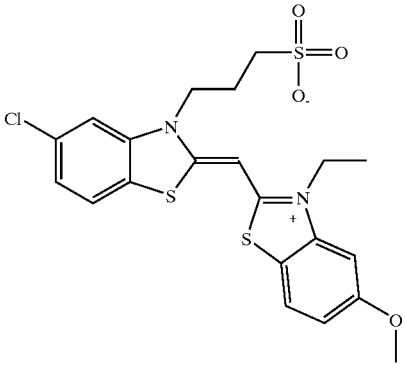
(II-6)
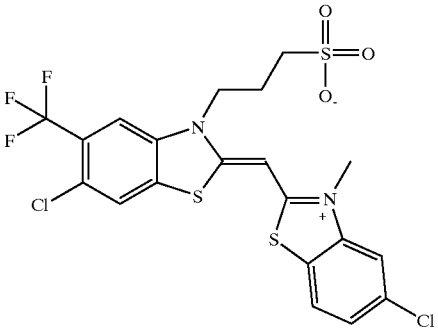
(II-7)
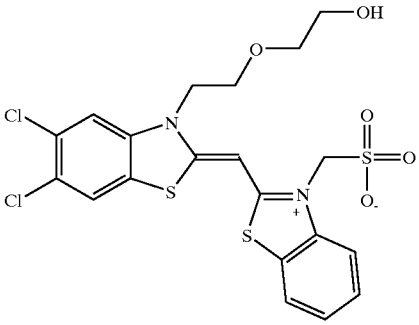
(II-8)
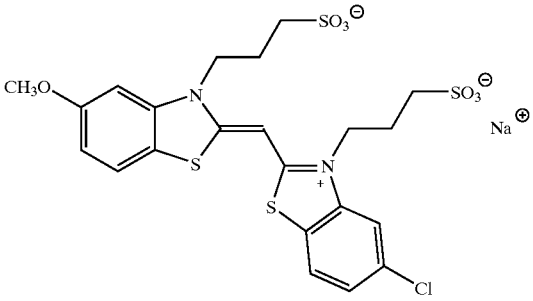

-continued (II-9)

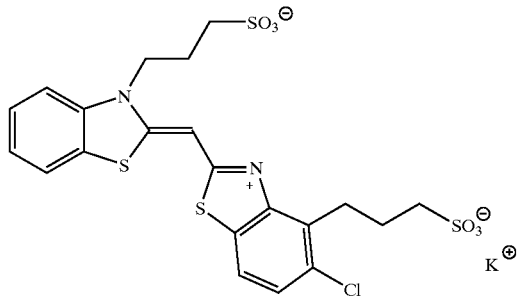

(II-10).

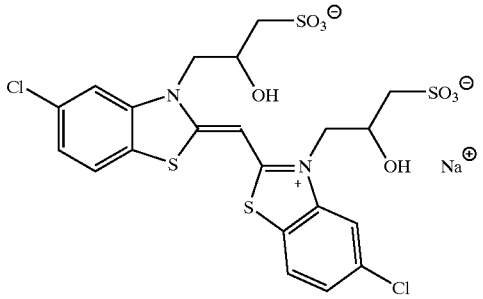

The spectral sensitizing dyes described herein can be prepared as described in U.S. Pat. No. 4,518,689 (Noguchi et al.), incorporated herein by reference, or by using known starting materials and synthetic procedures. Other details about such compounds are provided by Hamer, *The Cyanine Dyes and Related Compounds*, Interscience, New York, 1964.

Instability that increases minimum density in negative-type emulsion coatings (that is fog) can be protected against by incorporation of stabilizers, antifoggants, antikinking agents, latent-image stabilizers and similar addenda in the emulsion and contiguous layers prior to coating. Such addenda are illustrated by *Research Disclosure*, Item 38957, Section VII. Antifoggants and stabilizers, and Item 18431, Section II: Emulsion Stabilizers, Antifoggants and Antikinking Agents.

It may also be desirable that one or more silver halide emulsion layers include one or more covering power enhancing compounds adsorbed to surfaces of the silver halide grains. A number of such materials are known in the art, but preferred covering power enhancing compounds contain at least one divalent sulfur atom that can take the form of a —S— or ═S moiety. Such compounds include, but are not limited to, 5-mercapotetrazoles, dithioxotriazoles, mercapto-substituted tetraazaindenes, and others described in U.S. Pat. No. 5,800,976 (Dickerson et al.) that is incorporated herein by reference for the teaching of the sulfur-containing covering power enhancing compounds.

The silver halide emulsion layers and other hydrophilic layers on both sides of the support of the radiographic films generally contain conventional polymer vehicles (peptizers and binders) that include both synthetically prepared and naturally occurring colloids or polymers. Conventional gelatino-vehicles and related layer features are disclosed in *Research Disclosure*, Item 38957, Section II. Vehicles, vehicle extenders, vehicle-like addenda and vehicle related addenda. The emulsions themselves can contain peptizers of the type set out in Section II, paragraph A. Gelatin and hydrophilic colloid peptizers. The hydrophilic colloid peptizers are also useful as binders and hence are commonly present in much higher concentrations than required to perform the peptizing function alone.

Cationic starch used as a peptizer for tabular grains is described in U.S. Pat. No. 5,620,840 (Maskasky) and U.S. Pat. No. 5,667,955 (Maskasky). Both hydrophobic and hydrophilic synthetic polymeric vehicles can be used also. Such materials include, but are not limited to, polyacrylates (including polymethacrylates), polystyrenes and polyacrylamides (including polymethacrylamides). Dextrans can also be used. Examples of such materials are described for example in U.S. Pat. No. 5,876,913 (Dickerson et al.), incorporated herein by reference.

It is essential that the coated tabular grain silver halide emulsion layers, on one or both sides of the support, comprise tabular silver halide grains dispersed in a hydrophilic polymeric vehicle mixture comprising at least 0.5% and preferably at least 0.8% of oxidized gelatin based on the total weight of polymeric vehicle mixture in that coated emulsion layer. The upper limit for the oxidized gelatin is not critical but for practical purposes it is 1.5% based on the total weight of the polymer vehicle mixture. Preferably, from about 0.8 to about 1.2% (by weight) of the polymer vehicle mixture is oxidized gelatin.

It is also preferred that the oxidized gelatin is in the form of deionized oxidized gelatin but non-deionized oxidized gelatin can be used, or a mixture of deionized and non-deionized oxidized gelatins can be used. Deionized oxidized gelatin generally has the property of relatively lower amounts of methionine per gram of gelatin than other forms of gelatin. Preferably, the amount of methionine is from 0 to about 3 $\mu$mol of methionine, and more preferably from 0 to 1 $\mu$mol of methionine, per gram of gelatin. This material can be prepared using known procedures.

The remainder of the polymeric vehicle mixture can be any of the hydrophilic vehicles described above, but preferably it is composed of alkali-treated gelatin, acid-treated gelatin acetylated gelatin, or phthalated gelatin.

The silver halide emulsions containing the tabular silver halide grains described above can be prepared as noted using a considerable amount of oxidized gelatin (preferably deionized oxidized gelatin) during grain nucleation and growth, and then additional polymeric binder of any type can be added to provide the coating formulation. The amounts of oxidized gelatin in the emulsion can be as low as 0.3 g per mole of silver and as high as 27 g per mole of silver in the emulsion. Preferably, the amount of oxidized gelatin in the emulsion is from about 1 to about 20 g per mole of silver.

The silver halide emulsion layers (and other hydrophilic layers) in the radiographic films are generally fully hardened using one or more conventional hardeners. Thus, the amount of hardener in each silver halide emulsion and other hydrophilic layer is generally at least 0.6% and preferably at least 0.7%, based on the total dry weight of the polymer vehicle in each layer.

Conventional hardeners can be used for this purpose, including but not limited to formaldehyde and free dialdehydes such as succinaldehyde and glutaraldehyde, blocked dialdehydes, α-diketones, active esters, sulfonate esters, active halogen compounds, s-triazines and diazines, epoxides, aziridines, active olefins having two or more active bonds, blocked active olefins, carbodiimides, isoxazolium salts unsubstituted in the 3-position, esters of 2-alkoxy-N-carboxydi-hydroquinoline, N-carbamoyl pyridinium salts, carbamoyl oxypyridinium salts, bis(amidino) ether salts, particularly bis(amidino) ether salts, surface-applied carboxyl-activating hardeners in combination with complex-forming salts, carbamoylonium, carbamoyl pyridinium and carbamoyl oxypyridinium salts in combination with certain aldehyde scavengers, dication ethers, hydroxylamine esters of imidic acid salts and chloroformamidinium salts, hardeners of mixed function such as halogen-substituted aldehyde acids (for example, mucochloric and mucobromic acids), onium-substituted acroleins, vinyl sulfones containing other hardening functional groups, polymeric hardeners such as dialdehyde starches, and poly (acrolein-co-methacrylic acid).

The levels of silver and polymer vehicle in the radiographic silver halide film of the present invention are as follows. In general, the total amount of silver on each side of the support is at least 17 and no more than 21 mg/dm$^2$ in one or more emulsion layers. Preferably, the amount of silver on each side of the support is from about 17 to about 19 mg/dm$^2$. In addition, the total amount of polymer vehicle on each side of the support is generally at least 22 and no more than 30 mg/dm$^2$ in one or more hydrophilic layers. The amounts of silver and polymer vehicle on the two sides of the support in the radiographic silver halide film can be the same or different. These amounts refer to dry weights.

The radiographic silver halide films of this invention generally include a surface protective overcoat on each side of the support that typically provides physical protection of the emulsion layers. Each protective overcoat can be subdivided into two or more individual layers. For example, protective overcoats can be sub-divided into surface overcoats and interlayers (between the overcoat and silver halide emulsion layers). In addition to vehicle features discussed above the protective overcoats can contain various addenda to modify the physical properties of the overcoats. Such addenda are illustrated by *Research Disclosure*, Item 38957, Section IX. Coating physical property modifying addenda, A. Coating aids, B. Plasticizers and lubricants, C. Antistats, and D. Matting agents. Interlayers that are typically thin hydrophilic colloid layers can be used to provide a separation between the emulsion layers and the surface overcoats. The overcoat on at least one side of the support can also include a blue toning dye or a tetraazaindene (such as 4-hydroxy-6-methyl-1,3,3a,7-tetraazaindene) if desired.

The protective overcoat is generally comprised of one or more hydrophilic colloid vehicles, chosen from among the same types disclosed above in connection with the emulsion layers. Protective overcoats are provided to perform two basic functions. They provide a layer between the emulsion layers and the surface of the film for physical protection of the emulsion layer during handling and processing. Secondly, they provide a convenient location for the placement of addenda, particularly those that are intended to modify the physical properties of the radiographic film.

The various coated layers of radiographic silver halide films of this invention can also contain tinting dyes to modify the image tone to transmitted or reflected light. These dyes are not decolorized during processing and may be homogeneously or heterogeneously dispersed in the various layers. Preferably, such non-bleachable tinting dyes are in a silver halide emulsion layer.

Imaging Assemblies

The radiographic imaging assemblies of the present invention comprise a blue-sensitive radiographic silver halide film of this invention and one or more fluorescent intensifying screens that emit radiation having a maximum absorption at from about 300 to about 540 nm (preferably from about 360 to about 500 nm). These screens can take any convenient form providing they meet all of the usual requirements for use in radiographic imaging. Examples of conventional, useful fluorescent intensifying screens and methods of making them are provided by *Research Disclosure*, Item 18431, cited above, Section IX. X-Ray Screens/Phosphors, and U.S. Pat. No. 5,021,327 (Bunch et al.), U.S. Pat. No. 4,994,355 (Dickerson et al.), U.S. Pat. No. 4,997,750 (Dickerson et al.), and U.S. Pat. No. 5,108,881 (Dickerson et al.), the disclosures of which are here incorporated by reference. The fluorescent layer contains phosphor particles and a binder, optimally additionally containing a light scattering material, such as titania or light absorbing materials such as particulate carbon, dyes or pigments. Any conventional binder (or mixture thereof) can be used but preferably the binder is an aliphatic polyurethane elastomer or another highly transparent elastomeric polymer.

Any conventional or useful phosphor can be used, singly or in mixtures, in the intensifying screens used in the practice of this invention as long as the emitting radiation has the desired wavelength. For example, useful phosphors are described in numerous references relating to fluorescent intensifying screens, including but not limited to, *Research Disclosure*, Vol. 184, August 1979, Item 18431, Section IX, X-ray Screens/Phosphors.

Suitable phosphors are described in U.S. Pat. No. 4,835,397 (Arakawa et al.) and U.S. Pat. No. 5,381,015 (Dooms), both incorporated herein by reference, and including for example divalent europium and other rare earth activated alkaline earth metal halide phosphors and rare earth element activated rare earth oxyhalide phosphors. Of these types of phosphors, the more preferred phosphors include alkaline earth metal fluorohalide prompt emitting and/or storage phosphors [particularly those containing iodide such as alkaline earth metal fluorobromoiodide storage phosphors as described in U.S. Pat. No. 5,464,568 (Bringley et al.), incorporated herein by reference].

Another class of useful phosphors includes rare earth hosts such as rare earth activated mixed alkaline earth metal sulfates such as europium-activated barium strontium sulfate.

A representative fluorescent intensifying screen useful in the present invention is commercially available as Fuji Film HighPlus Screens that include calcium tungstate as the phosphor.

A particularly useful fluorescent intensifying screen can be prepared using an alkaline earth fluorohalide phosphor and especially a rare earth activated (doped) alkaline earth fluorohalide phosphor. An europium activated barium fluorohalide phosphor is most preferred.

Image Formation

Exposure and processing of the radiographic silver halide films of this invention can be undertaken in any convenient conventional manner. The exposure and processing techniques of U.S. Pat. No. 5,021,327 and U.S. Pat. No. 5,576,156 (both noted above) are typical for processing radiographic films. Other processing compositions (both developing and fixing compositions) are described in U.S. Pat. No. 5,738,979 (Fitterman et al.), U.S. Pat. No. 5,866,309 (Fitterman et al.), U.S. Pat. No. 5,871,890 (Fitterman et al.), U.S. Pat. No. 5,935,770 (Fitterman et al.), U.S. Pat. No. 5,942,378 (Fitterman et al.), all incorporated herein by reference. The processing compositions can be supplied as single- or multi-part formulations, and in concentrated form or as more diluted working strength solutions.

It is particularly desirable that the radiographic silver halide films be processed within 90 seconds ("dry-to-dry")

and preferably within 60 seconds (for a minimum of at least 20 seconds), for the developing, fixing, any washing (or rinsing) and drying steps. Such processing can be carried out in any suitable processing equipment including but not limited to, a Kodak X-OMAT™ RA 480 processor that can utilize Kodak Rapid Access processing chemistry. Other "rapid access processors" are described for example in U.S. Pat. No. 3,545,971 (Barnes et al.) and EP 0 248,390A1 (Akio et al.). Preferably, the black-and-white developing compositions used during processing are free of any gelatin hardeners, such as glutaraldehyde.

Since rapid access processors employed in the industry vary in their specific processing cycles and selections of processing compositions, the preferred radiographic films satisfying the requirements of the present invention are specifically identified as those that are capable of dry-to-dye processing according to the following reference conditions:

| | |
|---|---|
| Development | 11.1 seconds at 35° C., |
| Fixing | 9.4 seconds at 35° C., |
| Washing | 7.6 seconds at 35° C., |
| Drying | 12.2 seconds at 55–65° C. |

Any additional time is taken up in transport between processing steps. Typical black-and-white developing and fixing compositions are described in the Example below.

Radiographic kits can include a radiographic film or imaging assembly of this invention, one or more additional fluorescent intensifying screens and/or metal screens, and/or one or more suitable processing compositions (for example black-and-white developing and fixing compositions).

The following example is presented for illustration and the invention is not to be interpreted as limited thereby.

EXAMPLE

Radiographic Film A (Control)

Radiographic Film A was a dual-coated film having the same silver halide emulsion, interlayer, and overcoat layer on each side of a blue-tinted 178 μm transparent poly (ethylene terephthalate) film support. Each silver halide emulsion layer was a blend of a 3-dimensional silver iodobromide (3.4:96.3 molar ratio) emulsion and an internally fogged silver bromide emulsion. The silver halide grains were chemically sensitized with sodium thiosulfate, potassium tetrachloroaurate, sodium thiocyanate, and dimethylselenourea using conventional procedures. The emulsions were not spectrally sensitized. Radiographic Film A had the following layer arrangement:

Overcoat
Interlayer
Emulsion Layer
Support
Emulsion Layer
Interlayer
Overcoat

The noted layers were prepared from the following formulations.

| | Coverage (mg/dm$^2$) |
|---|---|
| Overcoat Formulation | |
| Gelatin vehicle | 3.4 |
| Methyl methacrylate matte beads | 0.28 |
| Carboxymethyl casein | 0.73 |
| Colloidal silica (LUDOX AM) | 1.06 |
| Polyacrylamide | 0.53 |
| Chrome alum | 0.025 |
| Resorcinol | 0.058 |
| Spermafol lubricant | 0.035 |
| TRITON ® X-200 E surfactant | 0.21 |
| LODYNE S-100 surfactant | 0.0015 |
| PLURONIC ® L43 surfactant | 0.0029 |
| Cysteine glutaraldehyde | $1.42 \times 10^{-5}$ |
| Interlayer Formulation | |
| Gelatin vehicle | 3.4 |
| Carboxymethyl casein | 0.73 |
| Colloidal silica (LUDOX AM) | 1.06 |
| Polyacrylamide | 0.53 |
| Chrome alum | 0.25 |
| Resorcinol | 0.058 |
| PLURONIC ® L43 surfactant | 0.0029 |
| Cysteine glutaraldehyde | $1 \times 10^{-5}$ |
| Emulsion Layer Formation | |
| 3-Dimensional grain emulsion [AgIBr 1.2 μm average size] | 21.6 |
| Fogged grain emulsion [AgBr 0.4 μm average size] | 2.48 |
| Gelatin vehicle | 15.1 |
| 4-Hydroxy-6-methyl-1,3,3a,7-tetraazaindene | 0.8 g/Ag mole |
| Potassium nitrate | 3.81 |
| Maleic acid hydrazide | 1.31 |
| Sorbitol | 1.26 |
| Glycerin | 2.02 |
| 3,5-Disulfocatechol | 4.69 g/Ag mole |
| Carboxymethylcasein | 1.62 |
| Polyacrylamide | 2.7 |
| Dextran | 5.4 |
| Chrome alum | 13.3 g/Ag mole |
| Bisvinylsulfonylmethylether | 0.5% based on total gelatin in all layers on each side |

Radiographic Film B (Control)

The layer arrangement of Film B was like that for Film A and contained the same overcoat and interlayers. The silver halide emulsion layer on each side was the same but different than that in Film A. Specifically, the emulsion disposed on each side of the support contained deionized oxidized gelatin that had been added at multiple times before and/or during the nucleation and early growth of the silver iodobromide tabular grains dispersed therein. The grains had a mean aspect ratio of about 22.5. The nucleation and early growth of the tabular grains were performed using a "bromide-ion-concentration free-fall" process in which a dilute silver nitrate solution was slowly added to a bromide ion-rich deionized oxidized gelatin environment. The iodide was added during grain growth as an Ag-controlling iodobromide salt containing 3.5 mol % iodide, starting after the beginning of growth (at 1.7% of the final grain volume) and ending at 85% of the final grain volume. This provided iodide in a localized portion of the grains of 1.7 to 85% where 100% refers to the grain surface. Between 85% and 100% of the grain volume of the grains was comprised of silver bromide only. The grains were chemically sensitized with aurousdithiosulfate, sodium thiocyanate, and potassium selenocyanate using conventional procedures. Spectral sensitization to the 470 nm region was provided using 521 mg/mole of silver of Dye II-1 shown below.

More specifically, each emulsion layer contained the following components:

| Emulsion Layer Formulation | Coverage (mg/dm$^2$) |
|---|---|
| Tabular grain emulsion [AgIBr (3:97 mol ratio, 2.7 × 0.12 μm average diameter and thickness] | 18.7 |
| Gelatin vehicle | 20.5 |
| 4-Hydroxy-6-methyl-1,3,3a,7-tetraazaindene | 2.1 g/Ag mole |
| Nitroindazole | 84.5 mg/Ag mole |
| Potassium nitrate | 3.81 |
| Sodium disulfocathecol | 4.69 g/Ag mole |
| Maleic acid hydrazide | 1.31 |
| Sorbitol | 1.26 |
| Glycerin | 2.02 |
| Dextran P | 5.4 |
| Carboxymethylcasein | 1.62 |
| Polyacrylamide | 2.7 |
| Chrome alum | 13.3 g/Ag mole |
| Bisvinylsulfonylmethane | 0.7% based on total gelatin in all layers on each side |

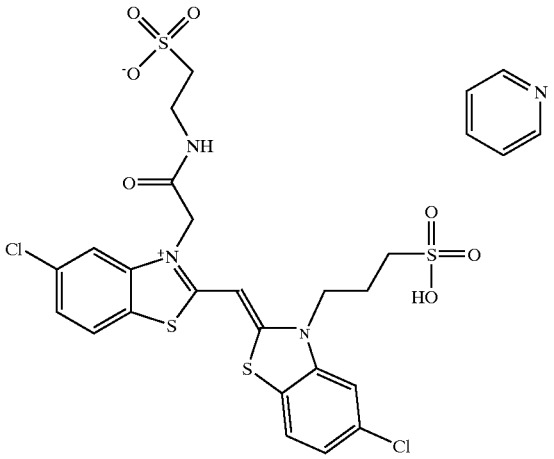

(II-1)

Radiographic Film C (Control)

Film C was prepared with the same construction and composition as Film B except that Dye I-1 (same amount) shown below was used in place of Dye II-1.

(I-1)

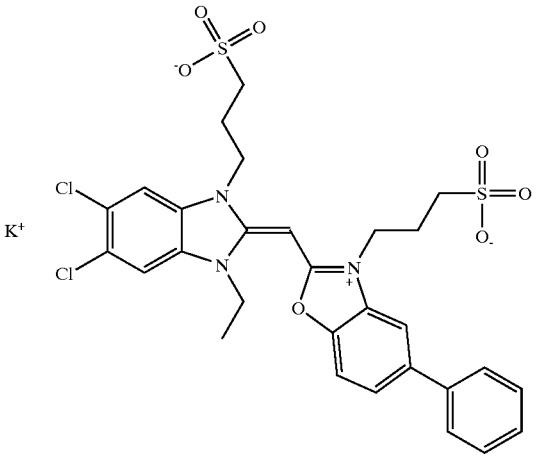

Radiographic Film D (Invention)

Film D was prepared with the construction and composition of Film B except that Dyes I-1 and II-1 were used in a molar ratio of 3:7 and the total amount of spectral sensitizers was 550 mg/mole of total silver.

Radiographic Film E (Invention)

Film E was prepared with the construction and composition of Film B except that the Dyes I-1 and II-1 were used in a molar ratio of 4:6 and the total amount of spectral sensitizers was 550 mg/mole of total silver.

Radiographic Film F (Control)

Film F was prepared with the construction and composition of Film B except that Dyes I-1 and II-1 were used in a molar ratio of 6:4 and the total amount of spectral sensitizers was 550 mg/mole of total silver.

Samples of each of the Films A–F were sandwiched between two conventional calcium tungstate, blue-emitting intensifying screens in an imaging assembly that were exposed to 70 kVp X-radiation, varying either current (mA) or time, using a three-phase commercially available Picker Medical (Model VTX-650)(™) X-ray unit containing filtration up to 3 mm of aluminum. Sensitometric gradations in exposure were achieved by using a 21-increment (0.1 logE) aluminum step wedge of varying thickness.

The exposed samples of Films A–F were processed using a processor commercially available under the trademark KODAK RP X-OMAT® film Processor M6A-N, M6B, or M35A. Development was carried out using the following black-and-white developing composition:

| | |
|---|---|
| Hydroquinone | 30 g |
| Phenidone | 1.5 g |
| Potassium hydroxide | 21 g |
| $NaHCO_3$ | 7.5 g |
| $K_2SO_3$ | 44.2 g |
| $Na_2S_2O_5$ | 12.6 g |
| Sodium bromide | 35 g |

-continued

| | |
|---|---|
| 5-Methylbenzotriazole | 0.06 g |
| Glutaraldehyde | 4.9 g |
| Water to 1 liter, pH 10 | |

The film samples were developed in each instance for less than 25 seconds. Fixing was carried out using KODAK RP X-OMAT® LO Fixer and Replenisher fixing composition (Eastman Kodak Company). Overall processing (dry-to-dry) was carried out within 90 seconds.

Optical densities are expressed below in terms of diffuse density as measured by a conventional X-rite Model 310TM densitometer that was calibrated to ANSI standard PH 2.19 and was traceable to a National Bureau of Standards calibration step tablet. The characteristic D vs. logE curve was plotted for each radiographic film that was imaged and processed. Speed of the combination of radiographic film was measured at a density of $1.4+D_{min}$. Gamma (contrast) is the slope (derivative) of the noted curves. "UDP" is the density measured at the last exposure step as determined by conventional densitometry.

"Dye stain" measurements were made by processing two samples of each film in the automatic film processor described above. One sample for each film was fixed and washed 4 times while a second sample of each film was fixed and washed only once. The purpose of multiple fixing and washing is to remove residual dye stain. Greater multiples of fixing and washing did not result in any further dye washout. Spectrophotometric measurements were made of each film sample and CIELAB measurements were made to obtain b* values. Yellow dye stain values were determined by subtracting the b* value of the single fix and wash film sample from the b* value of the multiple fix and wash film sample.

The following TABLE 1 shows the sensitometric properties and dye stain values of Films A–F. It is apparent from the data that both Films B and C provided adequate photographic speed with the presence of a single spectral sensitizing dye compared to Film A that contained no spectral sensitizing dyes. However, when two spectral sensitizing dyes were combined according to the present invention in Film D, surprisingly higher photographic speed was obtained over Film B or Film C. Both Films D and E of the invention exhibited reduced dye stain with the specific spectral sensitizing dyes used at the desired molar ratios. However, when the molar ratio of spectral sensitizing dyes was changed as in Film F, dye stain was reduced but the photographic speed was reduced considerably.

TABLE I

| Film | Silver level ($mg/m^2$) per side | Speed | Contrast | Fog ($D_{min}$) | UDP | Yellow Dye Stain |
|---|---|---|---|---|---|---|
| A (Control) | 24.1 | 159 | 2.5 | 0.24 | 3.3 | 0.2 |
| B (Control) | 18.7 | 157 | 3.3 | 0.25 | 3.4 | 2.4 |
| C (Control) | 18.7 | 155 | 3.2 | 0.25 | 3.5 | 0.4 |
| D (Invention) | 18.7 | 166 | 3.3 | 0.25 | 3.5 | 1.7 |
| E (Invention) | 18.7 | 165 | 3.3 | 0.26 | 3.5 | 1.4 |
| F (Control) | 18.7 | 128 | 2.7 | 0.23 | 3.3 | 1.2 |

The invention has been described in detail with particular reference to preferred embodiments thereof, but it will be understood that variations and modifications can be effected within the spirit and scope of the invention.

We claim:

1. A blue-sensitive radiographic silver halide film comprising a support having first and second major surfaces, said radiographic silver halide film having disposed on said first major support surface, one or more hydrophilic colloid layers including a first silver halide emulsion layer, and on the second major support surface, one or more hydrophilic colloid layers including a second silver halide emulsion layer, said first silver halide emulsion layer comprising predominantly tabular silver halide grains that have an aspect ratio of at least 15, a grain thickness of at least 0.1 $\mu$m, and comprise at least 90 mol % bromide and up to 4 mol % iodide, based on total silver halide, substantially all of said iodide being present in an internal localized portion of said tabular silver halide grains that excludes the surface of said grains, wherein said tabular silver halide grains in said first silver halide emulsion layer are dispersed in a hydrophilic polymeric vehicle mixture comprising at least 0.5% of oxidized gelatin, based on the total dry weight of said polymeric vehicle mixture, and wherein said tabular silver halide grains in said first silver halide emulsion layer are spectrally sensitized with a combination of first and second spectral sensitizing dyes that have maximum J-aggregate absorptions on said tabular silver halide grains of from about 380 to about 500 nm, wherein the maximum J-aggregate absorption of said first spectral sensitizing dye is from about 20 to about 50 nm lower in wavelength than the maximum J-aggregate absorption of said second spectral sensitizing dye, the molar ratio of said first spectral sensitizing dye to said second spectral sensitizing dye being from about 0.25:1 to about 1:1, and said first and second spectral sensitizing dyes being present to provide from about 50 to 100% of saturation coverage of said tabular silver halide grains.

2. The radiographic silver halide film of claim 1 wherein said tabular silver halide grains in said first silver halide emulsion layer comprise at least 90% of the total silver halide grains and said tabular silver halide grains comprise at least 95 mol % bromide and up to 3.5 mol % iodide based on total silver halide in said first silver halide emulsion layer.

3. The radiographic silver halide film of claim 1 wherein said second silver halide emulsion layer comprises predominantly tabular silver halide grains that have an aspect ratio of at least 15, a grain thickness of at least 0.1 $\mu$m, and comprise at least 90 mol % bromide and up to 4 mol % iodide, based on total silver halide, substantially all of said iodide being present in an internal localized portion of said tabular silver halide grains that excludes the surface of said grains, wherein said tabular silver halide grains in said second silver halide emulsion layer are dispersed in a hydrophilic polymeric vehicle mixture comprising at least 0.5% oxidized gelatin, based on the total dry weight of said polymeric vehicle mixture.

4. The radiographic silver halide film of claim 1 wherein said tabular silver halide grains in said first silver halide emulsion layer comprise iodide in a localized portion of said grains that is from about 1.5 to about 90 volume % of said grains wherein 100% volume represents the surface of said grains.

5. The radiographic silver halide film of claim 4 wherein said tabular silver halide grains in said first silver halide emulsion layer comprise iodide in a localized portion of said grains that is from about 1.7 to about 85 volume % of said grains wherein 100% volume represents the surface of said grains.

6. The radiographic silver halide film of claim 1 wherein said tabular silver halide grains in said first silver halide emulsion layer have an aspect ratio of from about 20 to about 30 and a grain thickness of from about 0.10 to about 0.14 $\mu$m.

7. The radiographic silver halide film of claim 1 comprising polymer vehicles on each side of said support in a total amount of from about 22 to about 30 mg/dm$^2$ and a level of silver on each side of said support of from about 17 to about 21 mg/dm$^2$.

8. The radiographic silver halide film of claim 1 wherein said first spectral sensitizing dye is an anionic benzimidazole-benzoxazole simple cyanine having at least one sulfo or carboxy group in the molecule, and said second spectral sensitizing dye is an anionic benzothiazole-benzothiazole simple cyanine having at least one sulfo or carboxy group in the molecule.

9. The radiographic silver halide film of claim 8 wherein said first spectral sensitizing dye is a monomethine cyanine dye represented by the following Structure I:

(I)

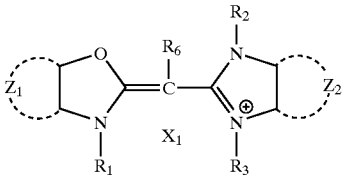

wherein $Z_1$ and $Z_2$ represent the carbon atoms necessary to form a substituted or unsubstituted benzene or naphthalene ring, $R_1$, $R_2$, and $R_3$ are independently substituted or unsubstituted alkyl, alkoxy, aryl, or alkenyl groups, $R_6$ is hydrogen or a substituted or unsubstituted alkyl or phenyl groups, $X_1$ is an anion or cation as needed, provided that Structure I also comprises at least one sulfo or carboxy group, and said second spectral sensitizing dye is a monomethine cyanine dye represented by the following Structure (II):

(II)

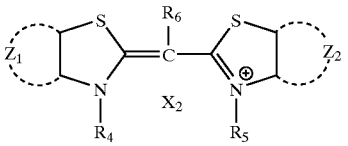

wherein $Z_1$ and $Z_2$ represent the carbon atoms necessary to form a substituted or unsubstituted benzene or naphthalene ring, $R_4$ and $R_5$ are independently substituted or unsubstituted alkyl, alkoxy, aryl, or alkenyl groups, $R_6$ is hydrogen or a substituted or unsubstituted alkyl or phenyl group, $X_2$ is an anion or cation as needed, and provided that Structure II also comprises at least one sulfo or carboxy groups.

10. The radiographic silver halide film of claim 9 wherein $R_1$, $R_2$, $R_3$, $R_4$, and $R_5$ are independently alkyl groups having 1 to 4 carbon atoms, phenyl groups, alkoxy groups having 1 to 4 carbon atoms, or alkenyl groups having 2 to 4 carbon atoms, $R_6$ is hydrogen, methyl, or ethyl groups, and each of said first and second spectral sensitizing dyes has at least two sulfo groups in the molecules.

11. The radiographic silver halide film of claim 1 wherein said first spectral sensitizing dye is one of the following Dyes I-1 through I-7, and said second spectral sensitizing dye is one of the following Dyes II-1 through II-10:

(I-1)

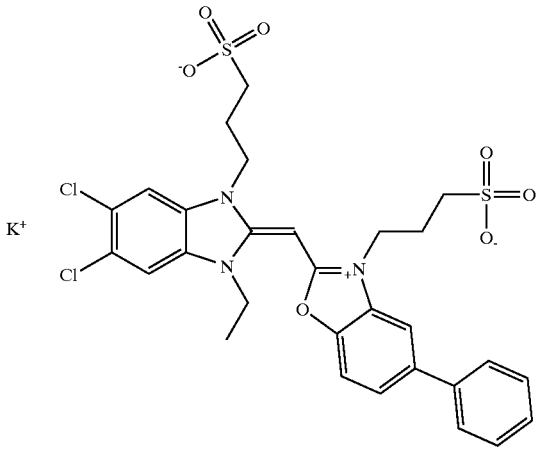

(I-2)

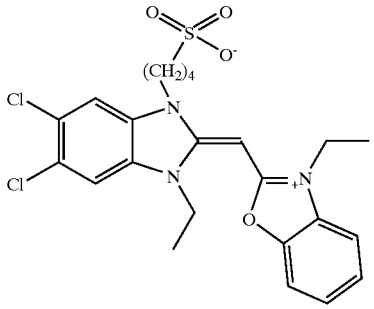

(I-3)

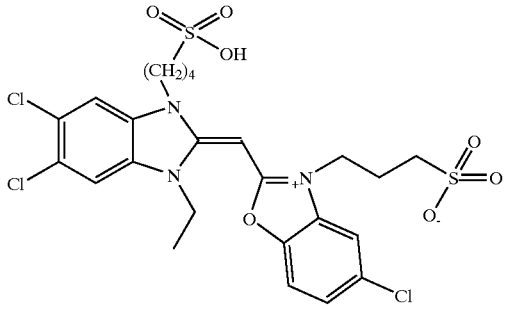

(I-4)

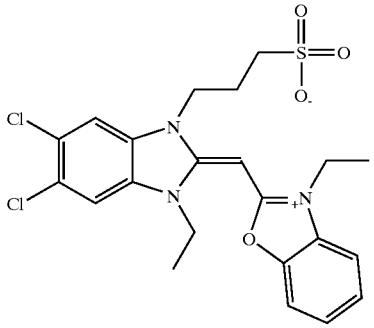

-continued
(I-5)
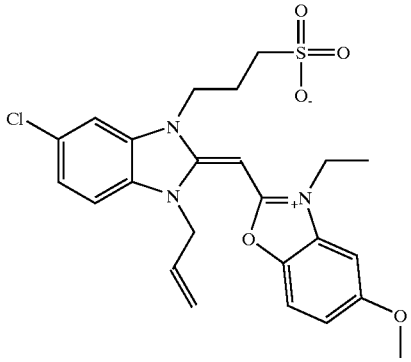
(I-6)
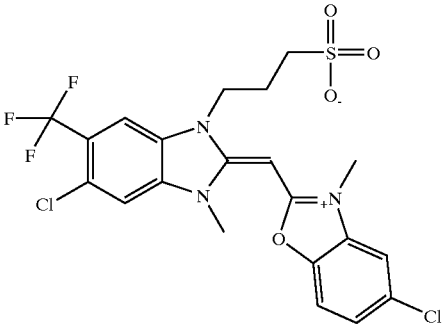
(I-7)
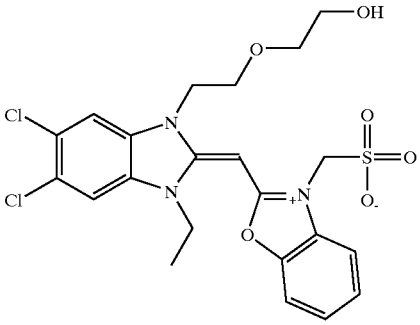
(II-1)
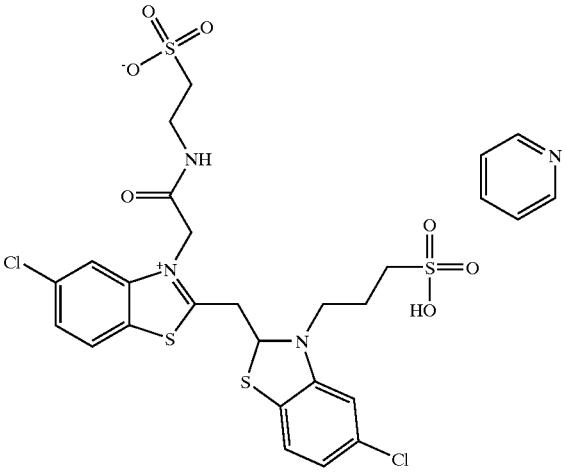
-continued
(II-2)
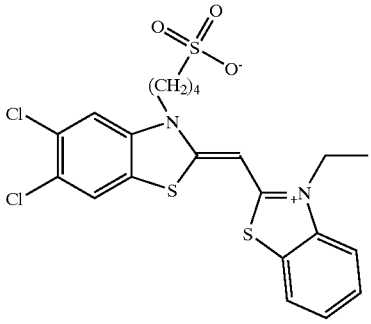
(II-3)
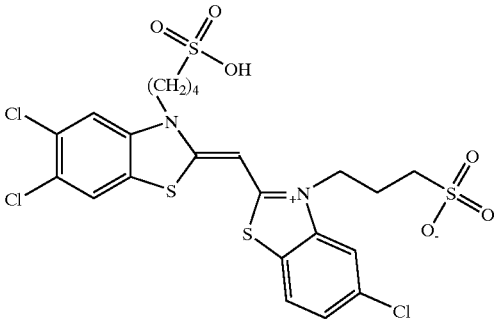
(II-4)
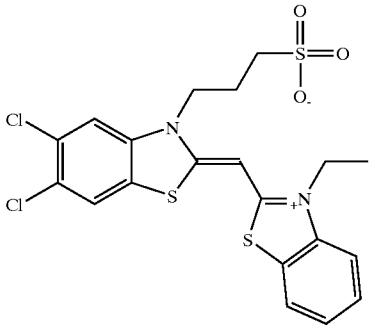
(II-5)
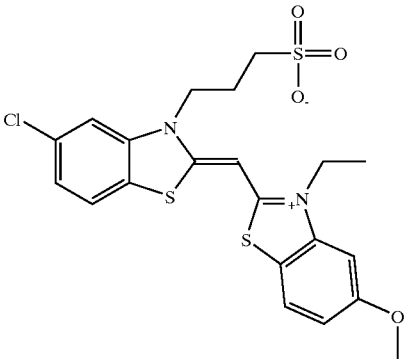

-continued (II-6)

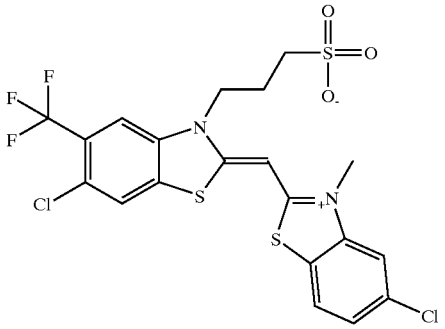

(II-7)

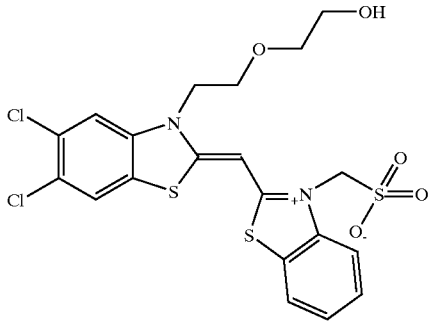

(II-8)

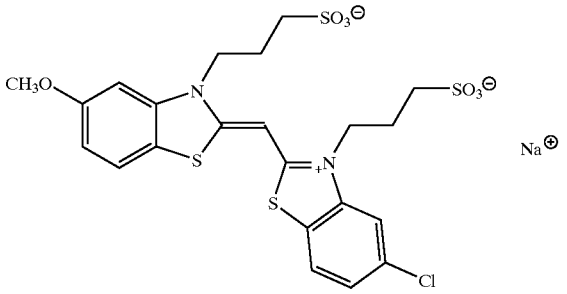

(II-9)

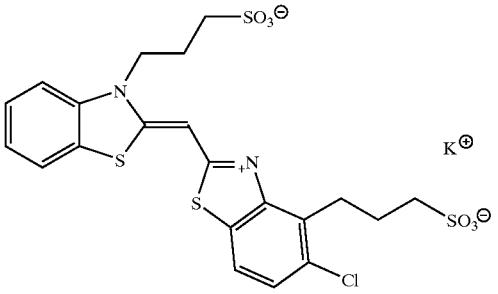

(II-10)

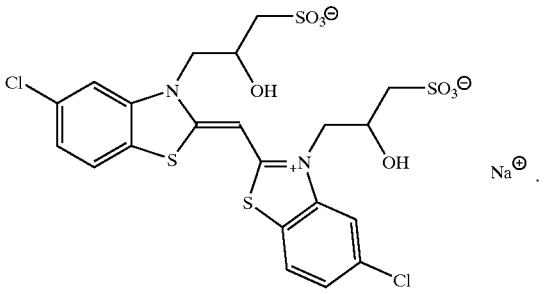

12. The radiographic silver halide film of claim 1 wherein the molar ratio of said first spectral sensitizing dye to said second spectral sensitizing dye is from about 0.3:1 to about 0.8:1 and said first and second spectral sensitizing dyes are present to provide from about 70 to about 80% saturation coverage of said tabular silver halide grains.

13. The radiographic silver halide of claim 1 wherein said first and second spectral sensitizing dyes are present in an amount of from about 400 to about 800 mg/mole of silver in said first silver halide emulsion layer.

14. The radiographic silver halide film of claim 1 wherein the maximum J-aggregate absorption of said first spectral sensitizing dye is from about 30 to about 45 nm lower in wavelength than the maximum J-aggregate absorption of said second spectral sensitizing dye, and said combination of said first and second spectral sensitizing dyes have maximum J-aggregate absorptions on said tabular silver halide grains of from about 410 to about 490 nm.

15. A blue-sensitive, radiographic silver halide film comprising a support having first and second major surfaces, said radiographic silver halide film having disposed on said first major support surface, one or more hydrophilic colloid layers including a first silver halide emulsion layer, and on the second major support surface, one or more hydrophilic colloid layers including a second silver halide emulsion layer, said first and second silver halide emulsion layers having essentially the same composition and comprising predominantly tabular silver halide grains that have an aspect ratio of from about 20 to about 30, a grain thickness of from about 0.10 to about 0.14 $\mu$m, and comprising at least 95 mol % bromide and from about 1 to about 3.5 mol % iodide, based on total silver halide in said emulsion layers, substantially all of said iodide being present in an internal localized portion of said tabular silver halide grains that from about 1.7 to about 85 volume % of said grains wherein 100% volume represents the surface of said grains, wherein said tabular silver halide grains in said first and second silver halide emulsion layers are dispersed in a hydrophilic polymeric vehicle mixture comprising from about 0.8% to about 1.2% of deionized oxidized gelatin, based on the total dry weight of said polymeric vehicle mixture, and wherein said tabular silver halide grains in said first and second silver halide emulsion layers are spectrally sensitized with a combination of first and second spectral sensitizing dyes that have maximum J-aggregate absorptions on said tabular silver halide grains of from about 410 to about 490 nm, wherein the maximum J-aggregate absorption of said first spectral sensitizing dye is from about 30 to about 45 nm lower in wavelength than the maximum J-aggregate absorption of said second spectral sensitizing dye, the molar ratio of said first spectral sensitizing dye to said second spectral sensitizing dye being from about 0.4:1 to about 0.7:1, and said first and second spectral sensitizing dyes being present to provide from about 70 to about 80% of saturation coverage of said tabular silver halide grains in both silver halide emulsion layers, said first spectral sensitizing dye being one of the following dyes I-1 through I-7 and said second spectral sensitizing dye being one of the following dyes II-1 through II-10:

(I-1)
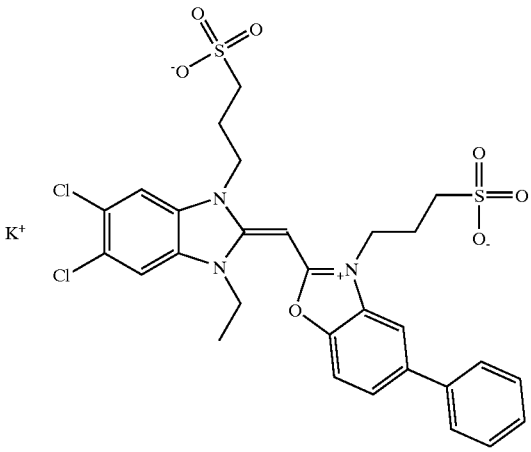
(I-2)
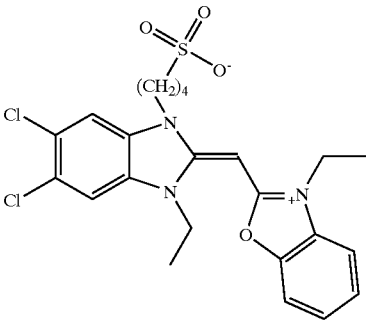
(I-3)
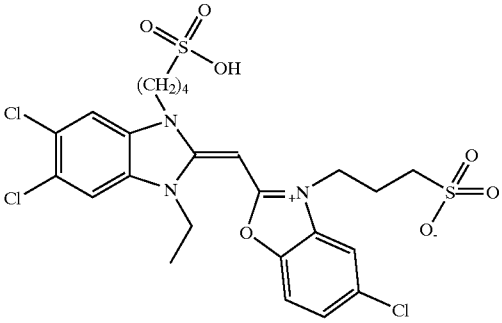
(I-4)
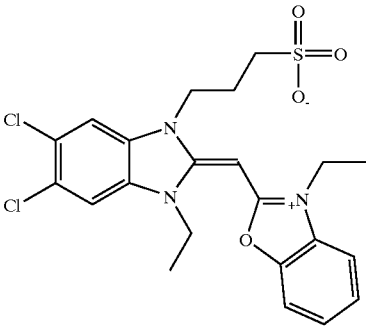
-continued
(I-5)
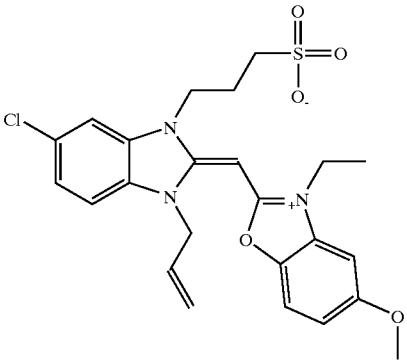
(I-6)
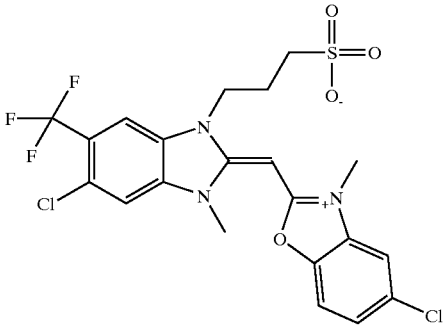
(I-7)
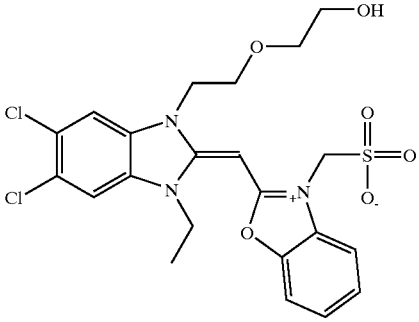
(II-1)
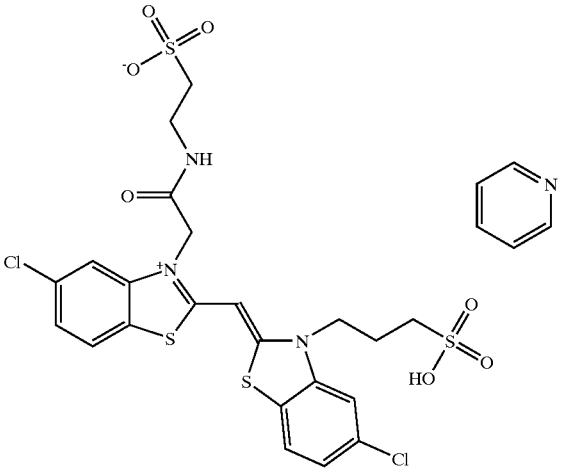

-continued
(II-2)
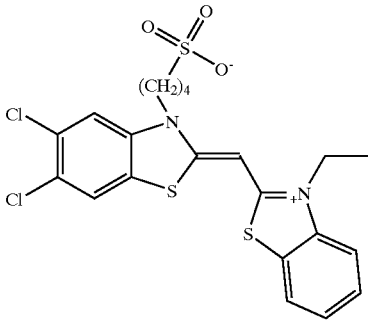
(II-3)
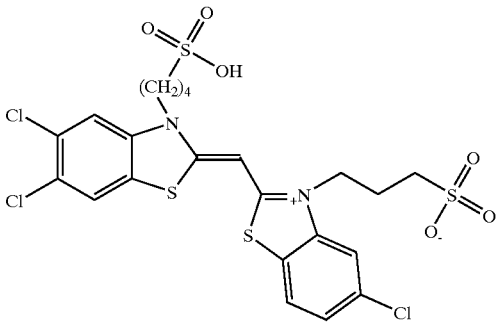
(II-4)
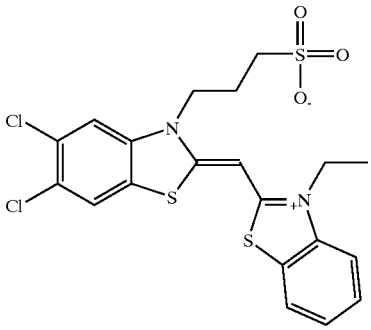
(II-5)
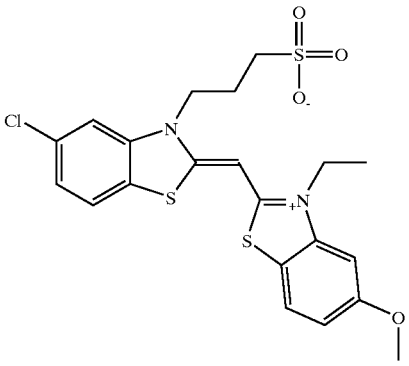
-continued
(II-6)
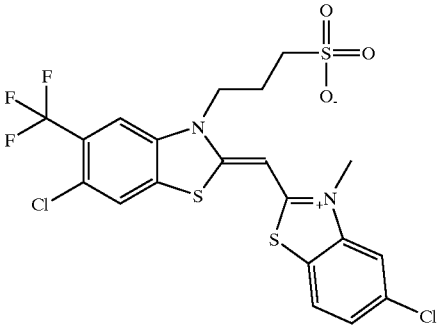
(II-7)
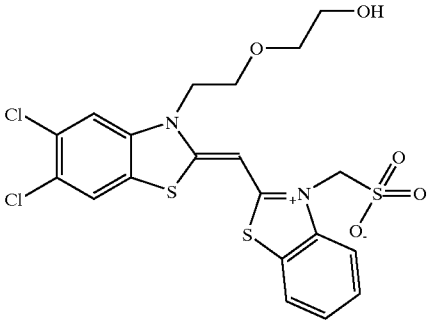
(II-8)
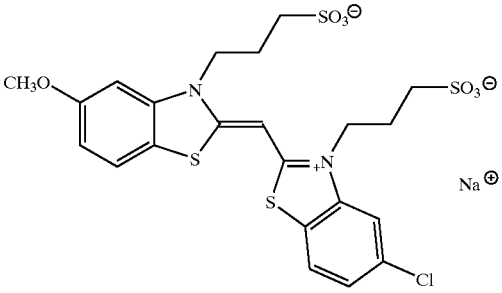
(II-9)
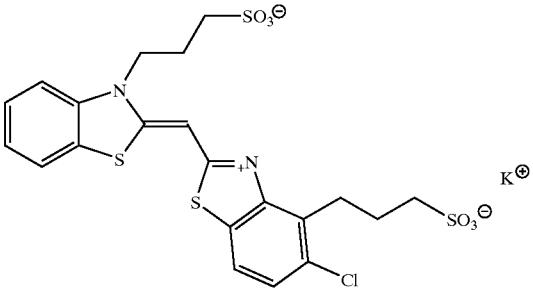
(II-10)
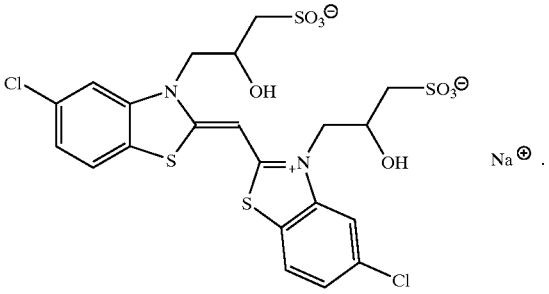

16. A photosensitive silver halide emulsion comprising predominantly tabular silver halide grains that have an aspect ratio of at least 15, a grain thickness of at least 0.1 $\mu$m, and comprise at least 90 mol % bromide and up to 4 mol % iodide, based on total silver halide, substantially all of the iodide being present in an internal localized portion of said tabular silver halide grains that excludes the surface of said grains, wherein said tabular silver halide grains are dispersed in a hydrophilic polymeric vehicle mixture comprising at least 0.3 g and up to 27 g of oxidized gelatin per mole of silver in said emulsion and wherein said tabular silver halide grains are spectrally sensitized with a combination of first and second spectral sensitizing dyes that have maximum J-aggregate absorptions on said tabular silver halide grains of from about 380 to about 500 nm, wherein the maximum J-aggregate absorption of said first spectral sensitizing dye is from about 20 to about 50 nm lower in wavelength than the maximum J-aggregate absorption of said second spectral sensitizing dye, the molar ratio of said first spectral sensitizing dye to said second spectral sensitizing dye being from about 0.25:1 to about 1:1, and said first and second spectral sensitizing dyes being present to provide from about 50 to 100% of saturation coverage of said tabular silver halide grains.

17. The emulsion of claim 16 wherein said tabular silver halide grains are dispersed in said hydrophilic polymeric vehicle mixture comprising from about 1 to about 20 g of oxidized gelatin per mole of silver in said emulsion.

18. The emulsion of claim 16 wherein at least 90% of the total silver halide grains are tabular silver halide grains that comprise at least 95 mol % bromide and up to 3.5 mol % iodide based on total silver halide.

19. The emulsion of claim 16 wherein said first spectral sensitizing dye is an anionic benzimidazole-benzoxazole simple cyanine having at least two sulfo or carboxy groups in the molecule, and said second spectral sensitizing dye is an anionic benzothiazole-benzothiazole simple cyanine having at least two sulfo or carboxy groups in the molecule, and the molar ratio of said first spectral sensitizing dye to said second spectral sensitizing dye being from about 0.3:1 to about 0.8:1.

20. A radiographic imaging assembly comprising:

A) the blue-sensitive radiographic silver halide film of claim 1, and

B) a fluorescent intensifying screen that comprises an inorganic phosphor capable of absorbing X-rays and emitting electromagnetic radiation having a wavelength of from about 360 to about 540 nm, said inorganic phosphor being coated in admixture with a polymeric binder in a phosphor layer onto a flexible support and having a protective overcoat disposed over said phosphor layer.

21. A radiographic imaging assembly comprising:

A) the blue-sensitive radiographic silver halide film of claim 15, and

B) a fluorescent intensifying screen that comprises a phosphor capable of absorbing X-rays and emitting electromagnetic radiation having a wavelength of from about 360 to about 540 nm, said phosphor being coated in admixture with a polymeric binder in a phosphor layer onto a flexible polymeric support and having a protective overcoat disposed over said phosphor layer.

22. A method of providing a black-and-white image comprising exposing the radiographic imaging assembly of claim 20, and processing said blue-sensitive radiographic silver halide film, sequentially, with a black-and-white developing composition and a fixing composition, said processing being carried out within 90 seconds, dry-to-dry.

23. The method of claim 22 wherein said processing is carried out for 60 seconds or less.

24. The method of providing a black-and-white image comprising exposing the blue-sensitive, radiographic silver halide film of claim 1, and processing said blue-sensitive radiographic silver halide film, sequentially, with a black-and-white developing composition and a fixing composition, said processing being carried out within 90 seconds, dry-to-dry.

* * * * *